US007306223B1

(12) United States Patent
Ting

(10) Patent No.: US 7,306,223 B1
(45) Date of Patent: Dec. 11, 2007

(54) MARBLE GAME MACHINE

(76) Inventor: James Ting, 7F, No. 356, Fu Hsing N. Rd., Taipei (TW)

( * ) Notice: Subject to any disclaimer, the term of this patent is extended or adjusted under 35 U.S.C. 154(b) by 9 days.

(21) Appl. No.: 11/476,168

(22) Filed: Jun. 28, 2006

(51) Int. Cl.
*A63F 7/00* (2006.01)

(52) U.S. Cl. ..... 273/119 R; 273/123 R

(58) Field of Classification Search ..... 273/119 R, 273/122 R, 123 R, 124 R, 125 R, 118 R, 273/129 R
See application file for complete search history.

(56) References Cited

U.S. PATENT DOCUMENTS 3,727,918 A * 4/1973 Zawacki ..... 473/159
3,990,573 A * 11/1976 Cross ..... 190/115
4,248,427 A * 2/1981 Vierimaa ..... 273/110
4,278,253 A * 7/1981 Hirose ..... 273/121 R
5,029,863 A * 7/1991 Krawczyk et al. ..... 273/125 R
5,415,401 A * 5/1995 Nagasaka ..... 273/110
6,299,164 B1 * 10/2001 Yi ..... 273/126 A
7,229,072 B2 * 6/2007 DiFrancesco, Jr. ..... 273/118 R

* cited by examiner

*Primary Examiner*—Raleigh W. Chiu
(74) *Attorney, Agent, or Firm*—Rosenberg, Klein & Lee

(57) ABSTRACT

A game machine includes a bed, a marble launching device fitted to a front end of the bed, a game plate supported on a rear section of the bed, and a bottom plate positioned under the bed; the game plate slopes up rearwards, and has several through holes thereon for allowing marbles to pass through; the marble launching device is used for launching marbles onto the game plate through a front section of the bed; the bottom plate has a marble receiving area, which projects out beyond a front end of the bed; the bottom plate has several lengthways extending trenches thereon therefore marbles will roll to the marble receiving area along the trenches when they fall through the through holes of the game plate.

10 Claims, 6 Drawing Sheets

MARBLE GAME MACHINE

BACKGROUND OF THE INVENTION

1. Field of the Invention

The present invention relates to a marble game machine, more particularly one, which has a relatively simple structure, and is entertaining and relatively inexpensive to manufacture.

2. Brief Description of the Prior Art

Many modern people like to do various recreational activities, e.g. drawing, fishing, and sports to alleviate the stress resulting from work. Many different kinds of entertaining game machines are available, e.g. pinball machines. However, most currently existing game machines are relatively complicated in structure, and expensive to manufacture.

Therefore, it is a main object of the present invention to provide a marble game machine, which has a relatively simple structure, and is entertaining and relatively inexpensive to manufacture.

SUMMARY OF THE INVENTION

The marble game machine of the present invention includes a bed, a marble launching device fitted to a front end of the bed, a game plate supported on a rear section of the bed, and a bottom plate positioned under the bed. The game plate slopes up rearwards, and has several through holes thereon for allowing marbles to fall through. The marble launching device is used for launching marbles onto the game plate through a front section of the bed. The bottom plate has a marble receiving area projecting out beyond a front end of the bed, and several lengthways extending trenches thereon therefore marbles will roll to the marble receiving area along the trenches when they fall through the through holes of the game plate.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
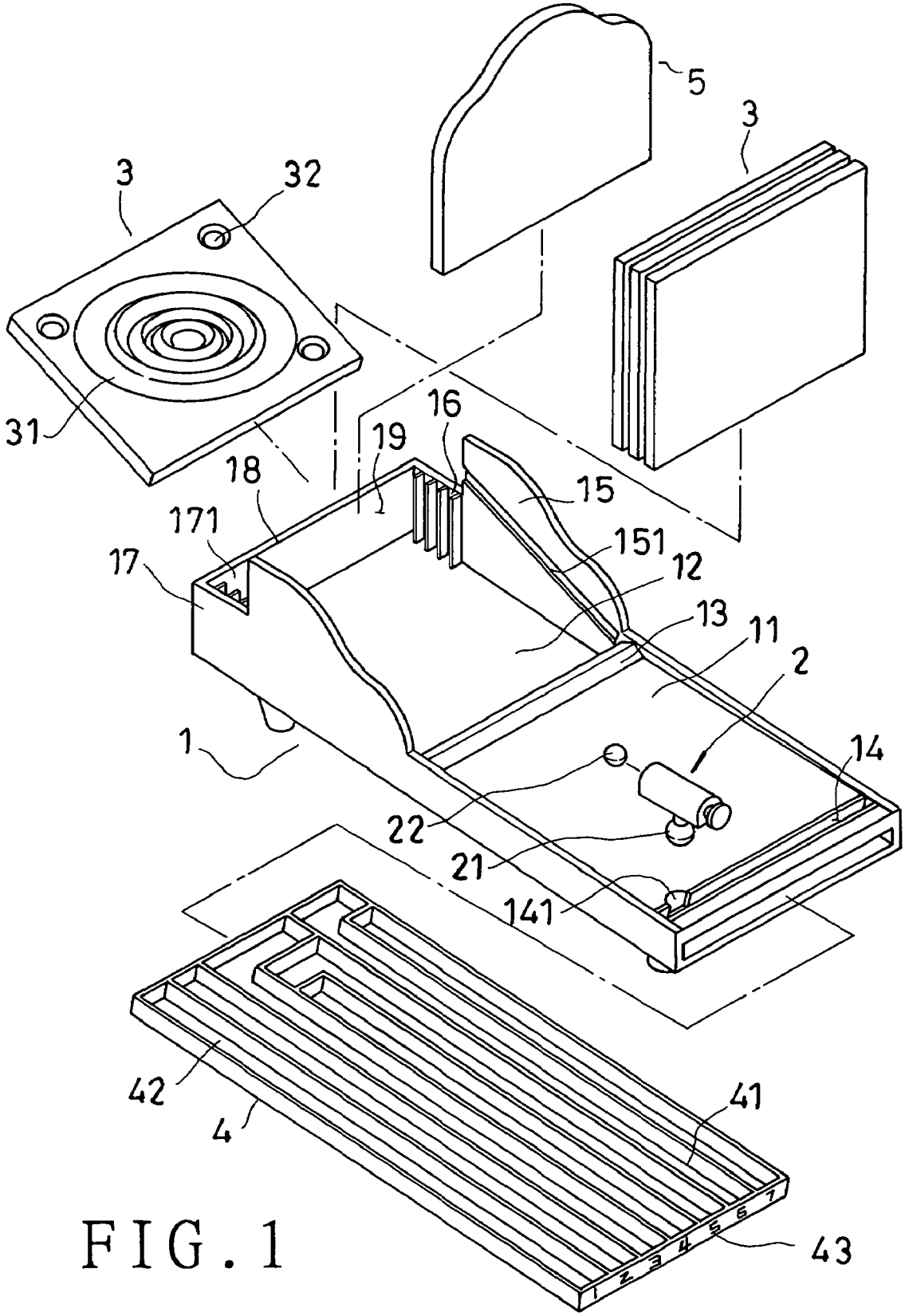
FIG. 1 is an exploded perspective view of the first preferred embodiment in the present invention.
Figure 2:
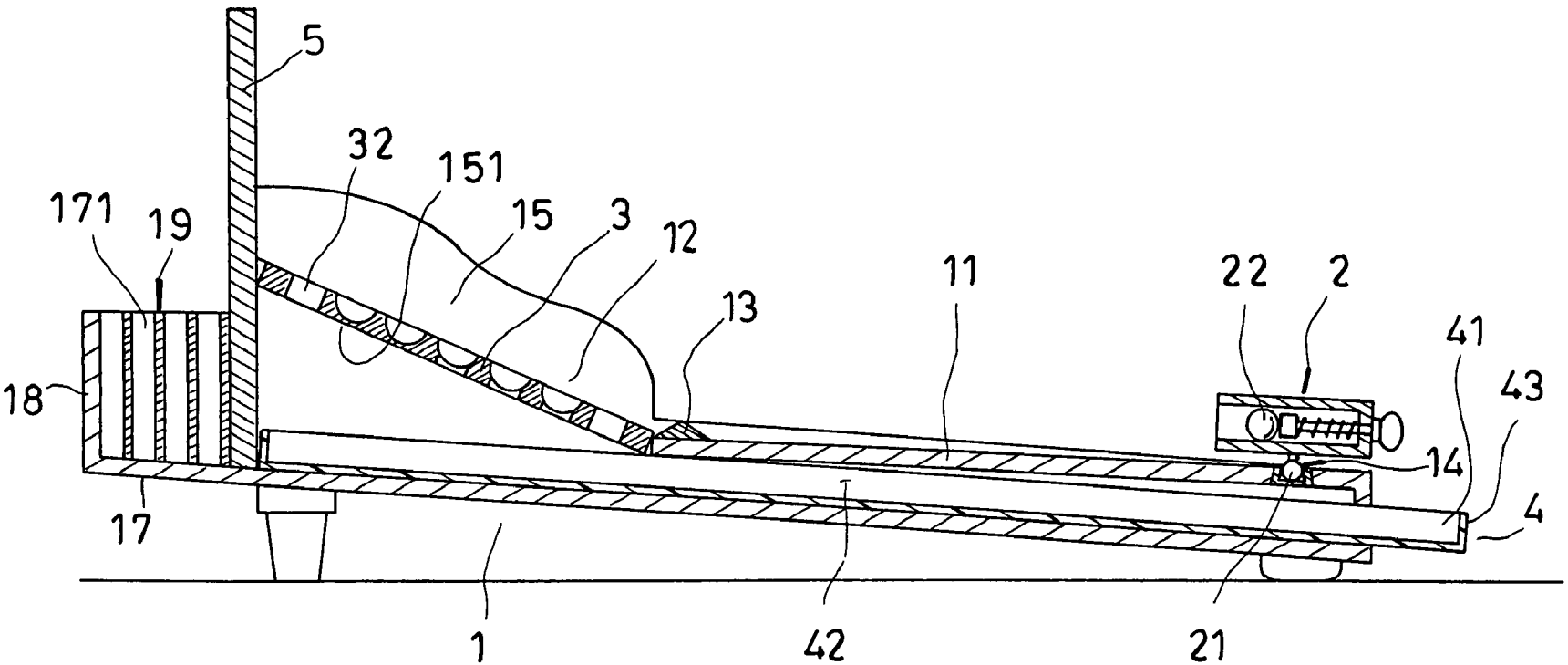
FIG. 2 is a lateral sectional view of the first preferred embodiment.
Figure 3:
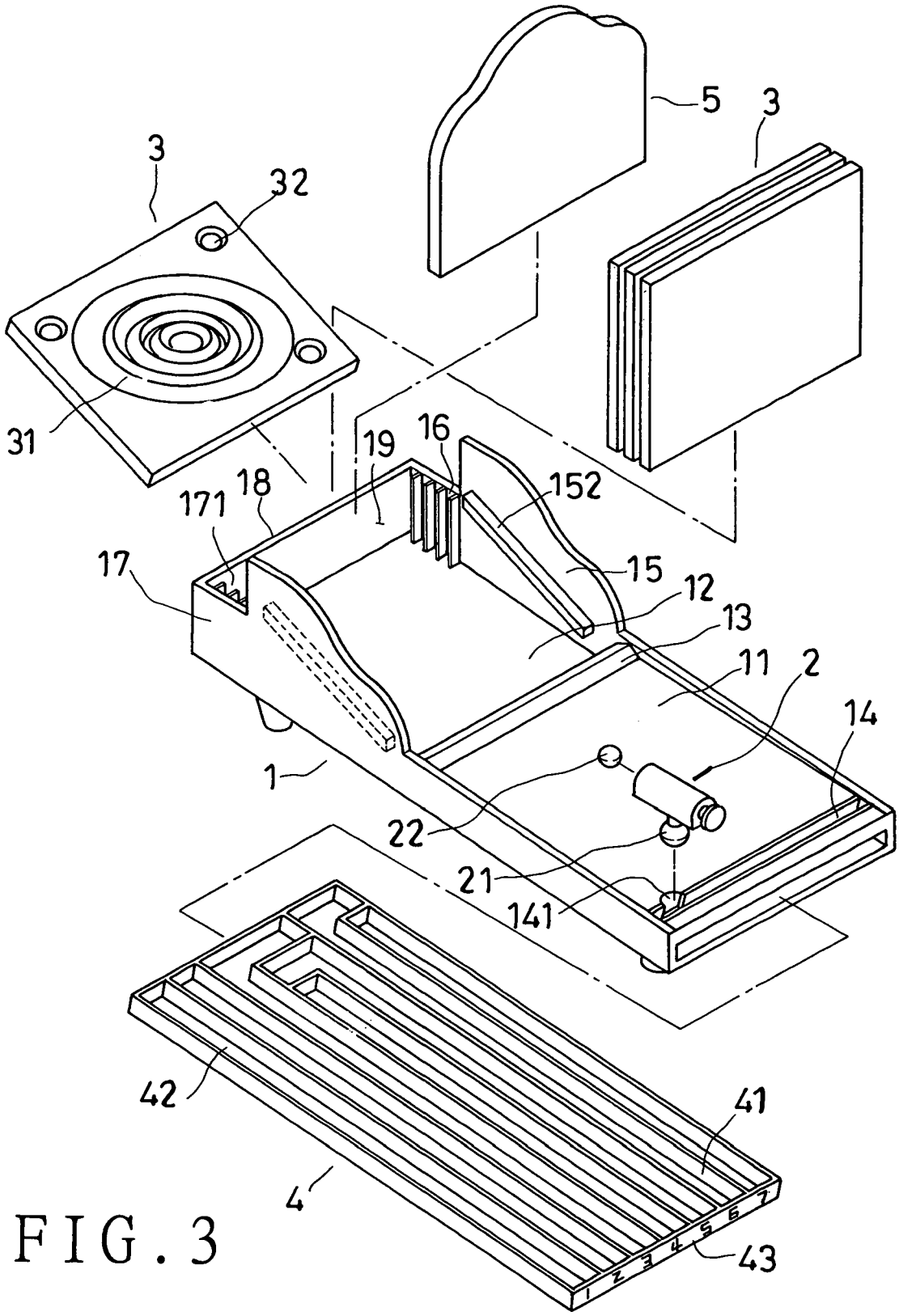
FIG. 3 is an exploded perspective view of the second embodiment.
Figure 4:
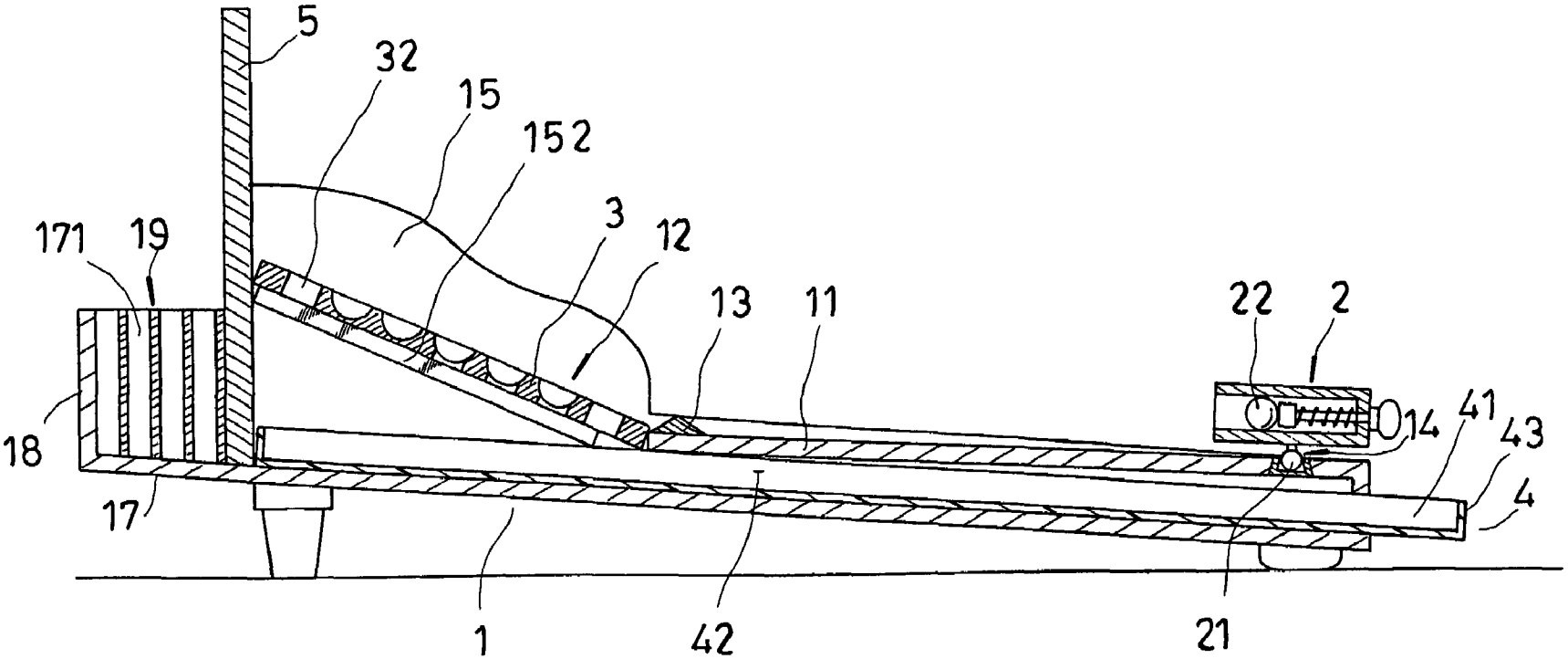
FIG. 4 is a lateral sectional view of the second embodiment.

Referring to FIGS. 1, 2, and 5 to 8, a first preferred embodiment of a marble game machine includes a bed 1, a marble launching device 2, several game plates 3, and a bottom plate 4.

The bed 1 slopes down towards a front end, and includes a front rolling section 11, a rear fitting section 12, a transverse separating bar 13 between the front rolling section 11 and the rear fitting section 12, a transverse ditch 14 next to a front end of the front rolling section 11, and two lateral walls.

The marble launching device 2 has a rolling bead 21 movably fitted on a lower end thereof. The transverse ditch 14 tapers towards an upper opening thereof, and has a receiving gap 141 for allowing the marble launching device 2 to be passed through at a lower end thereof; the marble launching device 2 can be linearly slid along the transverse ditch 14 after it is fitted in the transverse ditch 14; the marble launching device 2 can't be separated from the transverse ditch 14 if it is slid away from the receiving gap 141. The transverse separating bar 13 has a sloping side, which slopes up rearwards; a marble will be prevented from rolling back onto the rolling section 11 by means of the transverse separating bar 13 after it is launched by means of the marble launching device 2. Lateral stopping plates 15 projects up from rear portions of the lateral walls of the bed 1 so that the rear fitting section 12 is between the lateral stopping plates 15. Each of the lateral stopping plates 15 has an upright fitting groove 16 on inner sides of a rear end thereof, and a rear extension portion 17. A rear stopping plate 5 is fitted on the upright fitting grooves 16 at lateral sides thereof for stopping marbles. A rear plate 18 is connected to rear ends of the rear extension portions 17 of the lateral stopping plates 15; thus, a holding space 19 with an up facing opening is provided between the rear plate 18 and the rear stopping plate 5. Furthermore, the rear extension portions 17 of the lateral stopping plates 15 have several upright fitting grooves 171 on inner sides, on which the game plates 3 can be fitted at two sides when they aren't in use. Each of the lateral stopping plates 15 has a sloping groove 151 on an inner side thereof, which slopes down forwards, and on which a chosen one of the game plates 3 can be fitted from rear ends of the lateral stopping plates 15 for use.

Figure 7:
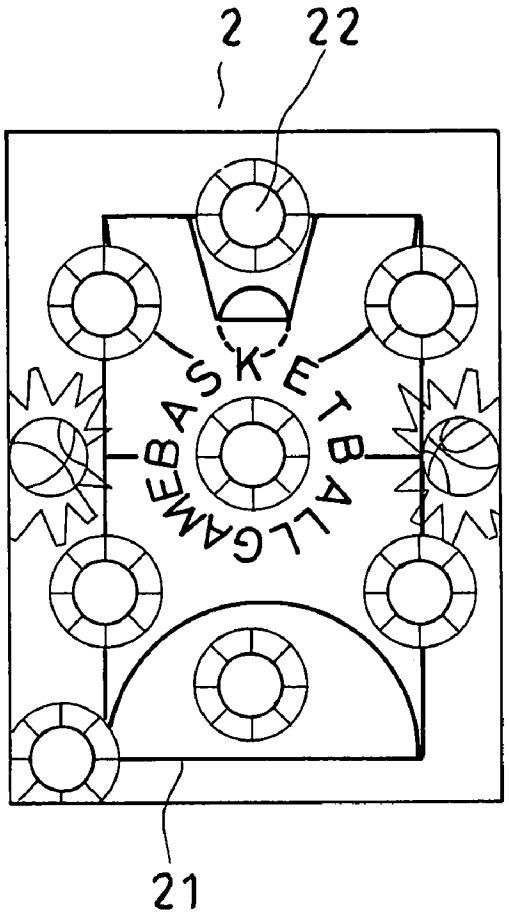
FIG. 7 is a view of a game plate like a basketball court.
Figure 6:
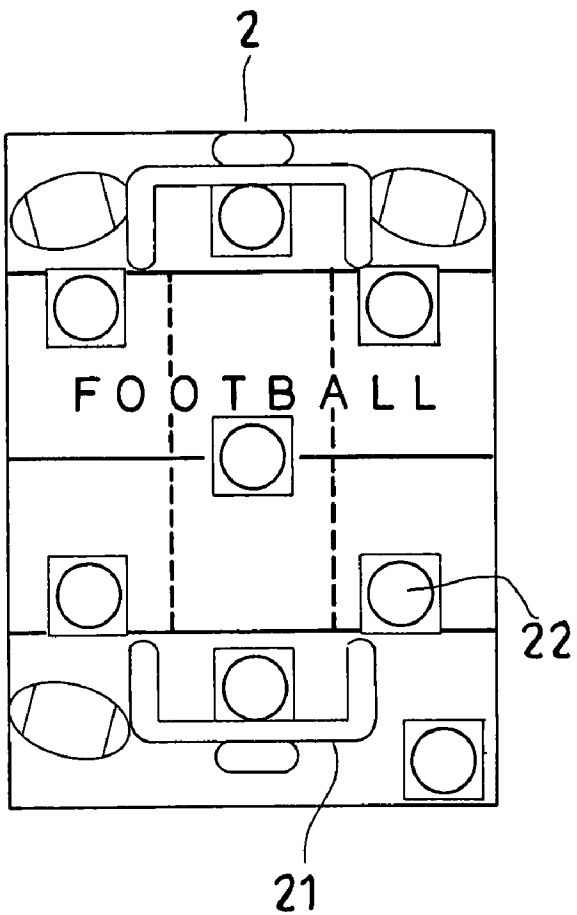
FIG. 6 is a view of a game plate like a football field.
Figure 5:
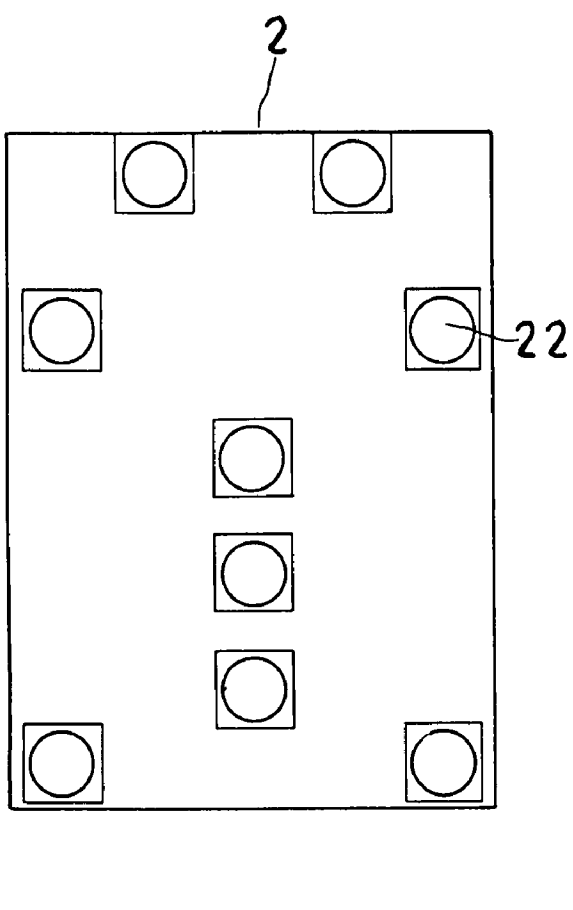
FIG. 5 is a view of a game plate, like a baseball field.
Figure 8:
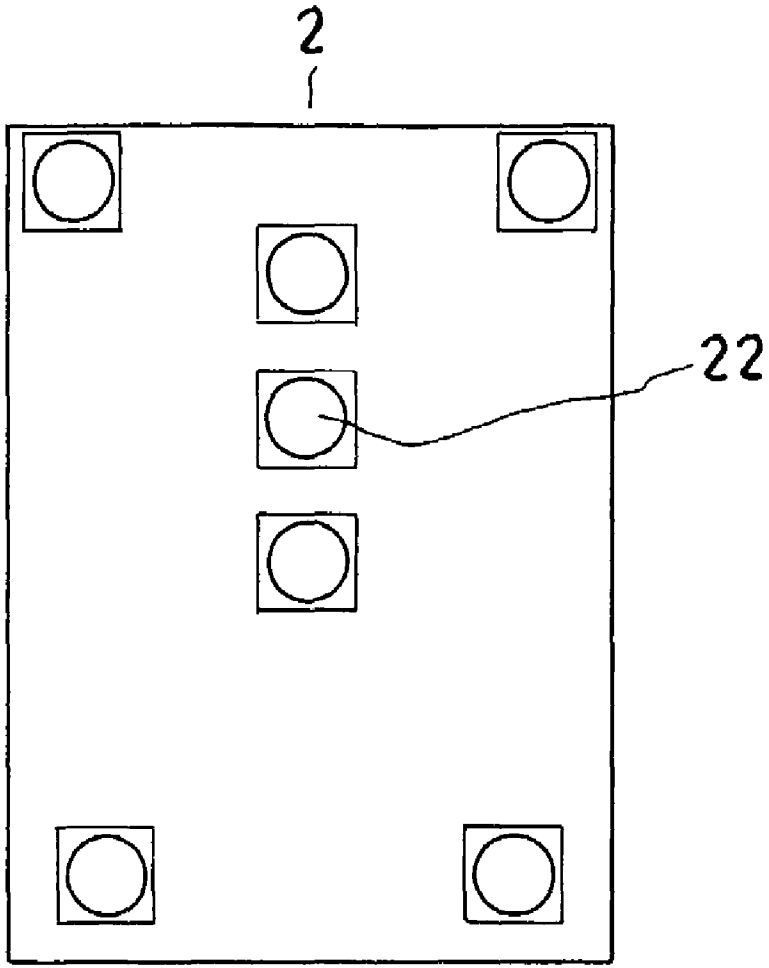
FIG. 8 is a view of a game plate like an upper side of a pinball machine.

Each of the game plates 3 has several through holes 32 thereon for allowing marbles to pass through. The game plates 3 have several pieces of drawings 31 stuck on upper sides thereof such that they look like a baseball field (FIG. 5), a football field (FIG. 6), a basketball court (FIG. 7) or a pinball machine (FIG. 8). And, the through holes 32 of the game plates 3 are formed at such position as to suit the drawings 31. Or alternatively, the game plates 3 have several pieces of drawings 31 stuck on each of two sides thereof; the drawings 31 on the two sides of the game plates 3 are different so that both sides of the game plates 3 can be used, as shown in FIG. 6 and FIG. 7.

The bottom plate 4 is positioned under the bed 1, and has several lengthways extending trenches 42 thereon, and a marble receiving area 41 at a front end thereof, which sticks out beyond the front end of the front rolling section 11 of the bed 1. A scoring plate 43 is stuck on a front end of the bottom plate 4, which has several different numerals thereon facing respective ones of the trenches 42 as well as representing respective scores.

To replace the currently used game plate 3, the user first has to lift the rear stopping plate 5 so as to remove the rear stopping plate 5 from the bed 1.

FIGS. 3 to 8 show a second preferred embodiment of a marble game machine in the present invention, which is substantially the same as the first preferred embodiment, and has a propping bar 152 on each of inner sides of lateral stopping plates 15 of the bed 1 instead; the propping bars 152 are used for propping a game plate 3, and slope down forwards. When a game plate 3 is supported on the propping bars 152, it will be stopped by a front end of the fitting section 12 at a front end, and stopped by the rear stopping plate 5 at a rear end thereof. Therefore, when a marble rolls onto the game plate 3, it will be confined within the game plate 3 by means of the lateral stopping plates 15, the rear stopping plate 5, and the transverse separating bar 13.

To change game plates 3, the user should first draw the rear stopping plate 5 up and away from the upright fitting grooves 16 of the lateral stopping plates 15, and next move the currently used game plate 3 away from the propping bars 152, which can be stored in the holding space 19. Next, one of the various game plates 3 is taken out of the holding space 19, and positioned on the propping bars 152 with its drawings 31 facing up, and with its front end touching a front end of the fitting section 12. And, the rear stopping plate 5 is fitted back onto the upright fitting grooves 16.

In playing game with the marble game machine, the player slides the marble launching device 2 on the ditch 14 to a proper position, and launches marbles by means of the marble launching device 2 so that the marbles roll onto the game plate 3 through the rolling section 11 of the bed 1; if the marbles fall through the through holes 32 of the game plate 3, they will fall onto the trenches 42 of the bottom plate 4, and roll into the marble receiving area 41, getting a score as indicated by means of the corresponding numeral on the scoring plate 43; if the marbles fail to fall through the through holes 32 of the game plate 3, they will roll to the transverse separating bar 13 owing to the slope of the game plate 3, fall through a no-score through hole 32 onto a corresponding trench 42, and also roll into the marble receiving area 41, getting zero point.

From the above description, it can be seen that the marble game machine of the present invention has a relatively simple structure, is relatively inexpensive to manufacture and entertaining, and the player is allowed to choose among several game plates with different drawings, which can be easily fitted on the bed for use.

What is claimed is:

1. A marble game machine, comprising a bed, the bed including a front rolling section, and a rear fitting section; the bed having a lateral stopping plate on each of two lateral sides of the rear fitting section thereof; each of the lateral stopping plates having an upright fitting groove on an inner side thereof;

a rear stopping plate, the rear stopping plate being fitted on the upright fitting grooves of the lateral stopping plates at two sides thereof;

a marble launching device fitted to a front end of the bed for launching marbles towards a rear end of the bed;

a game plate positioned between the lateral stopping plates and in front of the rear stopping plate; the game plate sloping up rearwards; the game plate having a plurality of through holes thereon for allowing marbles to pass through; the game plate touching the rear stopping plate at a rear end, and touching a front end of the rear fitting section of the bed at a front end thereof; and a bottom plate positioned under the bed, the bottom plate having a marble receiving area, which projects out beyond a front end of the rolling section of the bed; the bottom plate having a plurality of lengthways extending trenches thereon such that marbles will roll to the marble receiving area along the trenches when they fall through the through holes of the game plate.

2. The marble game machine as recited in claim 1, wherein the bed slopes down forwards.

3. The marble game machine as recited in claim 1, wherein the marble launching device has a rolling bead movably fitted on a lower end thereof, and the bed has a transverse ditch; the transverse ditch tapering towards an upper opening thereof; the transverse ditch having a receiving gap for allowing the marble launching device to be passed through at a lower end; the marble launcher being capable of linearly sliding along the transverse ditch after it is fitted in the transverse ditch;

the marble launcher being incapable of being separated from the transverse ditch after it is slid away from the receiving gap.

4. The marble game machine as recited in claim 1, wherein the bed has a transverse separating bar between the front rolling section and the rear fitting section; the transverse separating bar sloping up rearwards; the transverse separating bar being going to prevent marbles from rolling back onto the front rolling section of the bed when the marbles are launched onto the rear fitting section through the front rolling section.

5. The marble game machine as recited in claim 1, wherein each of the lateral stopping plates has a rear extension portion, and a rear plate is connected to rear ends of the rear extension portions of the lateral stopping plates such that a holding space with an up facing opening is provided; the rear extension portions of the lateral stopping plates having a plurality of second upright fitting grooves on inner sides thereof for allowing a plurality of game plates to be fitted on.

6. The marble game machine as recited in claim 1, wherein each of the lateral stopping plates has a sloping groove on an inner side thereof, which slopes down forwards; the game plate being fitted onto the sloping grooves at two sides thereof from rear ends of the lateral stopping plates.

7. The marble game machine as recited in claim 1, wherein each of the lateral stopping plates has a propping bar on an inner side thereof, which slopes down forwards; said game plate being supported on the propping bars.

8. The marble game machine as recited in claim 1 further having a plurality of game plates for replacing said game plate with.

9. The marble game machine as recited in claim 1, wherein the game plate has plural of pieces of drawings stuck on one side thereof.

10. The marble game machine as recited in claim 1, wherein the game plate has plural pieces of drawings stuck on each of two sides thereof; the drawings on the two sides of the game plate being different.

* * * * *